US010206484B2

(12) United States Patent
Wilson et al.

(10) Patent No.: US 10,206,484 B2
(45) Date of Patent: Feb. 19, 2019

(54) AIRLESS COSMETICS DISPENSER

(71) Applicant: HCT GROUP HOLDINGS LIMITED, Central (CN)

(72) Inventors: Jeremy Wilson, Los Angeles, CA (US); Armando Villarreal, Los Angeles, CA (US); Denis Maurin, Los Angeles, CA (US)

(73) Assignee: HCT GROUP HOLDINGS LIMITED, Hong Kong (HK)

( * ) Notice: Subject to any disclaimer, the term of this patent is extended or adjusted under 35 U.S.C. 154(b) by 0 days.

(21) Appl. No.: 15/454,713

(22) Filed: Mar. 9, 2017

(65) Prior Publication Data

US 2017/0265624 A1 Sep. 21, 2017

Related U.S. Application Data

(60) Provisional application No. 62/309,029, filed on Mar. 16, 2016.

(51) Int. Cl.

| | |
|---|---|
| ***B43K 5/02*** | (2006.01) |
| ***A45D 40/26*** | (2006.01) |
| ***A45D 40/00*** | (2006.01) |
| ***B05B 11/00*** | (2006.01) |
| ***A46B 11/00*** | (2006.01) |
| ***A45D 34/04*** | (2006.01) |

(52) U.S. Cl.

CPC ..... *A45D 40/262* (2013.01); *A45D 34/04* (2013.01); *A45D 40/0075* (2013.01); *A46B 11/00* (2013.01); *A46B 11/002* (2013.01); *B05B 11/0035* (2013.01); *B05B 11/3001* (2013.01); *B05B 11/3004* (2013.01); *B05B 11/3052* (2013.01); *A45D 2200/056* (2013.01); *A46B 2200/1053* (2013.01); *B05B 11/0038* (2018.08); *B05B 11/00416* (2018.08); *B05B 11/3023* (2013.01); *B05B 11/3074* (2013.01)

(58) Field of Classification Search

CPC .. A45D 34/041; A45D 34/042; A45D 40/261; A45D 40/262; A45D 2200/054; A45D 2200/055; A45D 2200/056; A45D 2200/1018

USPC ..... 401/188 R

See application file for complete search history.

(56) References Cited

U.S. PATENT DOCUMENTS

| | | | |
|---|---|---|---|
| 2,816,308 | A | 12/1957 | Schultz |
| 2,866,993 | A | 1/1959 | Edelstone |

(Continued)

FOREIGN PATENT DOCUMENTS

| | | | |
|---|---|---|---|
| CN | 2606543 | Y | 3/2004 |
| CN | 2717278 | Y | 8/2005 |

(Continued)

OTHER PUBLICATIONS

International Search Report and Written Opinion dated Jun. 19, 2017 for International Application No. PCT/US2017/021618.

*Primary Examiner* — Jennifer C Chiang

(74) *Attorney, Agent, or Firm* — Seager, Tufte & Wickhem LLP

(57) ABSTRACT

A product dispenser is provided that includes a container within a shell, and a pump and insert for dispensing the product. A spring biases the container and pump away from the tip of the shell. The bottom of the container is pushed up relative to the shell to activate the pump, thereby dispensing the product.

20 Claims, 14 Drawing Sheets

(56) References Cited

U.S. PATENT DOCUMENTS

| | | | | |
|---|---|---|---|---|
| 3,644,707 | A | 2/1972 | Costello | |
| 3,710,985 | A | 1/1973 | Baum | |
| D235,418 | S | 6/1975 | Petterson | |
| 4,029,422 | A | 6/1977 | Pillsbury | |
| 4,147,284 | A | 4/1979 | Mizzi et al. | |
| 4,454,966 | A | 6/1984 | Hicks | |
| 4,456,155 | A | 6/1984 | Miyata et al. | |
| 4,470,715 | A | 9/1984 | Reuchlin et al. | |
| 4,592,745 | A | 6/1986 | Rex et al. | |
| 4,630,955 | A | 12/1986 | Ladd, Jr. et al. | |
| 4,671,431 | A | 6/1987 | Obrist | |
| 4,708,267 | A | 11/1987 | Sieverding et al. | |
| 4,874,117 | A | 10/1989 | Kay et al. | |
| 4,877,157 | A | 10/1989 | Saulle | |
| 4,880,326 | A | 11/1989 | Spivey et al. | |
| 4,906,120 | A | 3/1990 | Sekiguchi et al. | |
| 4,983,059 | A | 1/1991 | Holloway | |
| D317,253 | S | 6/1991 | Seager | |
| 5,025,960 | A | 6/1991 | Seager | |
| 5,567,073 | A | 10/1996 | Laforcade et al. | |
| 5,738,067 | A | 4/1998 | Landwehr et al. | |
| 5,839,626 | A | 11/1998 | Gross et al. | |
| 5,951,185 | A | 9/1999 | Kingsford et al. | |
| 6,027,272 | A | 2/2000 | Spencer et al. | |
| 6,068,421 | A | 5/2000 | Pierpoint | |
| 6,102,602 | A | 8/2000 | Kageyama et al. | |
| 6,142,692 | A | 11/2000 | Garcia | |
| 6,309,124 | B1 | 10/2001 | Gueret | |
| 6,332,561 | B1 | 12/2001 | Garcia et al. | |
| 6,412,659 | B1 * | 7/2002 | Kneer | B05B 11/0037 222/105 |
| 6,758,374 | B2 | 7/2004 | Albisetti | |
| 6,923,589 | B2 | 8/2005 | Blackwell | |
| 7,040,830 | B2 | 5/2006 | Kliegman et al. | |
| D533,074 | S | 12/2006 | Mongeon | |
| 7,201,527 | B2 | 4/2007 | Thorpe et al. | |
| 7,419,323 | B1 | 9/2008 | Zhang | |
| 7,476,048 | B2 | 1/2009 | Prague | |
| 7,878,727 | B2 | 2/2011 | Koptis | |
| 7,959,369 | B2 | 6/2011 | Gueret | |
| 8,074,665 | B2 | 12/2011 | Pires et al. | |
| 8,161,983 | B1 | 4/2012 | Lee | |
| 8,308,386 | B2 * | 11/2012 | Ki | A45D 34/042 401/176 |
| 8,499,970 | B2 | 8/2013 | Yoo | |
| 8,678,693 | B2 | 3/2014 | Sturgis et al. | |
| 8,714,857 | B1 | 5/2014 | Liu | |
| 8,839,803 | B2 | 9/2014 | Holloway | |
| 9,016,968 | B2 | 4/2015 | Thorpe | |
| 9,538,824 | B2 * | 1/2017 | Villarreal | B05B 11/0043 |
| 9,770,736 | B2 * | 9/2017 | Brugger | B05C 17/00569 |
| 2003/0231924 | A1 | 12/2003 | Libman et al. | |
| 2004/0120753 | A1 | 6/2004 | Gieux | |
| 2004/0222124 | A1 | 11/2004 | Byun | |
| 2006/0207627 | A1 | 9/2006 | Thorpe et al. | |
| 2006/0216104 | A1 | 9/2006 | Bouix et al. | |
| 2007/0014624 | A1 | 1/2007 | Fogelson et al. | |
| 2007/0186951 | A1 | 8/2007 | Gueret | |
| 2007/0205233 | A1 | 9/2007 | Petit et al. | |
| 2007/0206986 | A1 | 9/2007 | Gueret | |
| 2009/0097899 | A1 | 4/2009 | Carroll | |
| 2009/0261127 | A1 | 10/2009 | Pan | |
| 2009/0311036 | A1 * | 12/2009 | Pires | A45D 34/04 401/263 |
| 2010/0215422 | A1 | 8/2010 | Carroll et al. | |
| 2010/0224652 | A1 | 9/2010 | Lim | |
| 2012/0031925 | A1 | 2/2012 | Greenberg | |
| 2012/0267390 | A1 | 10/2012 | Jeong et al. | |
| 2012/0267398 | A1 | 10/2012 | Lim | |
| 2013/0017010 | A1 | 1/2013 | Liu | |
| 2013/0048658 | A1 | 2/2013 | Sawata | |
| 2013/0343798 | A1 | 12/2013 | Delage et al. | |
| 2014/0061243 | A1 | 3/2014 | Goettke | |
| 2014/0234010 | A1 | 8/2014 | Thorpe et al. | |
| 2014/0270897 | A1 | 9/2014 | Laurusonis | |
| 2016/0007718 | A1 | 1/2016 | Villarreal et al. | |

FOREIGN PATENT DOCUMENTS

| | | | |
|---|---|---|---|
| CN | 200941885 | Y | 9/2007 |
| EP | 181184 | A2 | 5/1986 |
| FR | 925899 | A | 9/1947 |
| FR | 2989290 | B1 | 5/2014 |
| GB | 2404370 | B | 11/2005 |
| JP | 05072756 | U | 10/1993 |
| JP | 08238884 | A | 9/1996 |
| JP | 2000254575 | A | 9/2000 |
| JP | 2000279870 | A | 10/2000 |
| JP | 2003135140 | A | 5/2003 |
| JP | 3628037 | B2 | 3/2005 |
| KR | 19970000120 | A | 1/1997 |
| KR | 19980056332 | A | 9/1998 |
| KR | 20020039098 | A | 5/2002 |
| KR | 200388116 | Y1 | 6/2005 |
| KR | 200433606 | Y1 | 12/2006 |
| KR | 1020090087074 | A | 8/2009 |
| KR | 100935907 | B1 | 1/2010 |
| KR | 200471796 | Y1 | 3/2014 |
| WO | 2012074162 | A1 | 6/2012 |
| WO | 2015147526 | A1 | 10/2015 |

* cited by examiner

AIRLESS COSMETICS DISPENSER

CROSS REFERENCE TO RELATED APPLICATIONS

The present application claims the benefit of and priority to U.S. Provisional Patent Application Ser. No. 62/309,029, filed Mar. 16, 2016, titled AIRLESS CRAYON, the disclosure of which is incorporated herein by reference.

FIELD

The present application relates to the field of product dispensers. Particularly, the present application relates to cosmetics dispensers with an internal airless mechanism for dispensing the product.

BACKGROUND

Crayon, pencil, stick, brush, and doe foot type devices exist for applying cosmetics or medicinal products. Such devices may consist of a tubular shell for holding the product, a mechanism for dispensing the product, a shaped tip, and an optional cap. In the cosmetics and personal care industries, crayon, stick, and doe foot type applicators are used to apply lipstick, lip gloss, lip balm, skin creams, lotions, foundation, concealer, eye shadow, and other cosmetic products to portions of the body. Brush type applicators are used to apply mascara, gel and other products to eyelashes, eyebrows, and hair. In addition, various stick type applicators such as pencils, crayons, and chubby crayons exist. These implements typically consist of a tubular body with an applicator tip. Gel, paste, and cream products may be provided in the applicator. A mechanism is provided to move product from a reservoir to the tip for application. If air is allowed into the reservoir, the composition of the product may be changed and bacteria may be introduced, potentially resulting in degradation of the product. If no mechanism is provided to expel all of the product, product may be wasted. Accordingly, there remains a need in the art for improved crayon, stick, brush, and doe foot type application devices.

SUMMARY

In an illustrative example, a product dispenser is provided comprising a container having a closed bottom and an open top, a shell disposed at least partially over the container, the shell having an open bottom with an extension, and an opening in a top end, the shell configured to receive the container therein with the container bottom being substantially flush with the shell extension in a rest position, a pump mechanism disposed with the open top of the container, an insert disposed within an upper portion of the shell, the insert having a snap connection with one or both of the shell and the container, and a spring disposed between the pump mechanism and the insert, biasing the closed bottom of the container flush with the shell extension.

In an example, the snap connection may be between the insert and the shell, the snap connection including a projection on the insert that engages an extension on an inner surface of the shell.

In a further example, the insert may have a second snap connection with the container.

In a further example, the second snap connection may include a lip on the insert that engages a protrusion on an inner surface of the container.

In another example, a bottom end of the spring may engage the container and an upper end of the spring engages the insert.

In a further example, the product dispenser comprises a tip disposed within the opening at the top end.

In another example, the insert may have a channel extending longitudinally therethrough, allowing product to travel from the pump mechanism to the tip.

In a further example, the tip may have an opening that is fluidly connected to a passageway extending through the pump mechanism and insert to the container.

In another example, the tip may include a conical application surface with an apex, wherein the opening is in the apex.

In another example, the tip may include a doe foot applicator.

In another example, the tip may include a brush.

In a further example, the brush may include a plurality of openings fluidly connected to the passageway.

BRIEF DESCRIPTION OF THE DRAWINGS

In the drawings, which are not necessarily drawn to scale, like numerals may describe similar components in different views. The drawings illustrate generally, by way of example, but not by way of limitation, various embodiments discussed in the present document.

DETAILED DESCRIPTION

Figure 1:
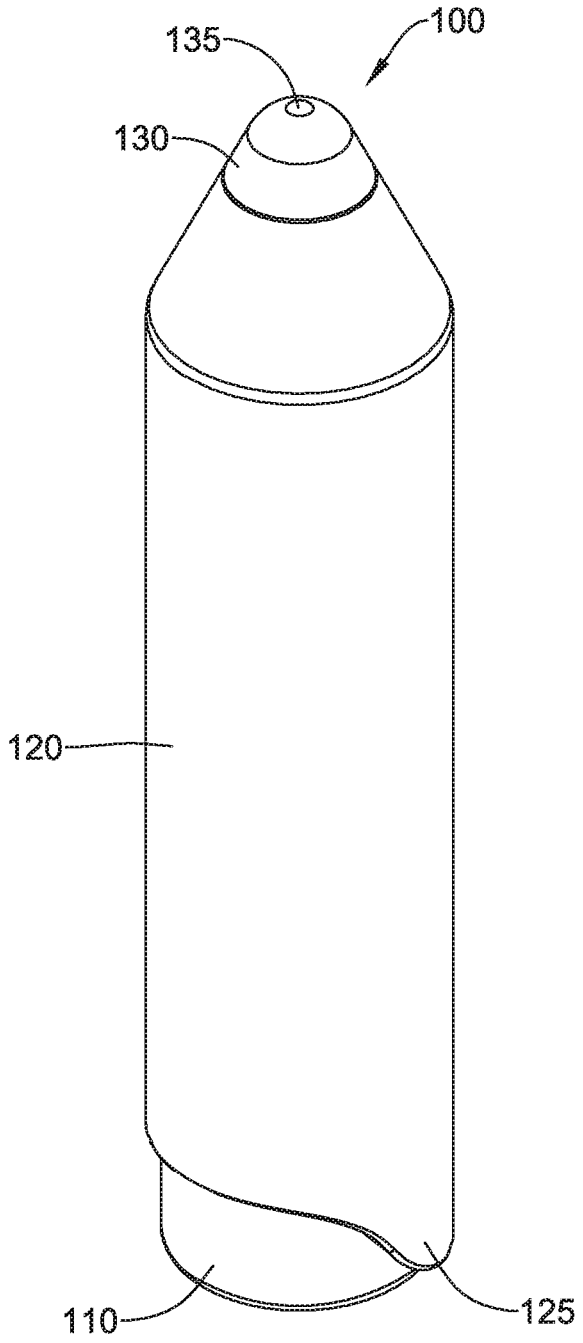
FIG. 1 is a perspective view of an illustrative dispenser.

In the following descriptions of the figures, the terms proximal, upper, or top may be used in reference to the portion of elements nearest the top of the page as they are shown in the drawings and the terms distal, lower, or bottom may be used in reference to the portion of elements nearest the bottom of the page as they are shown in the drawings.

FIG. 1 is a perspective view of an illustrative product dispenser. The container may contain cosmetic products. Cosmetic products that the present invention may contain may include, without limitation, lip gloss, lipstick, lip stain, lip balm, concealer, eye primer, eye shadow, skin cream, lotion, foundation and other products dispensed in cream, lotion, or gel formulation.

Figure 11:
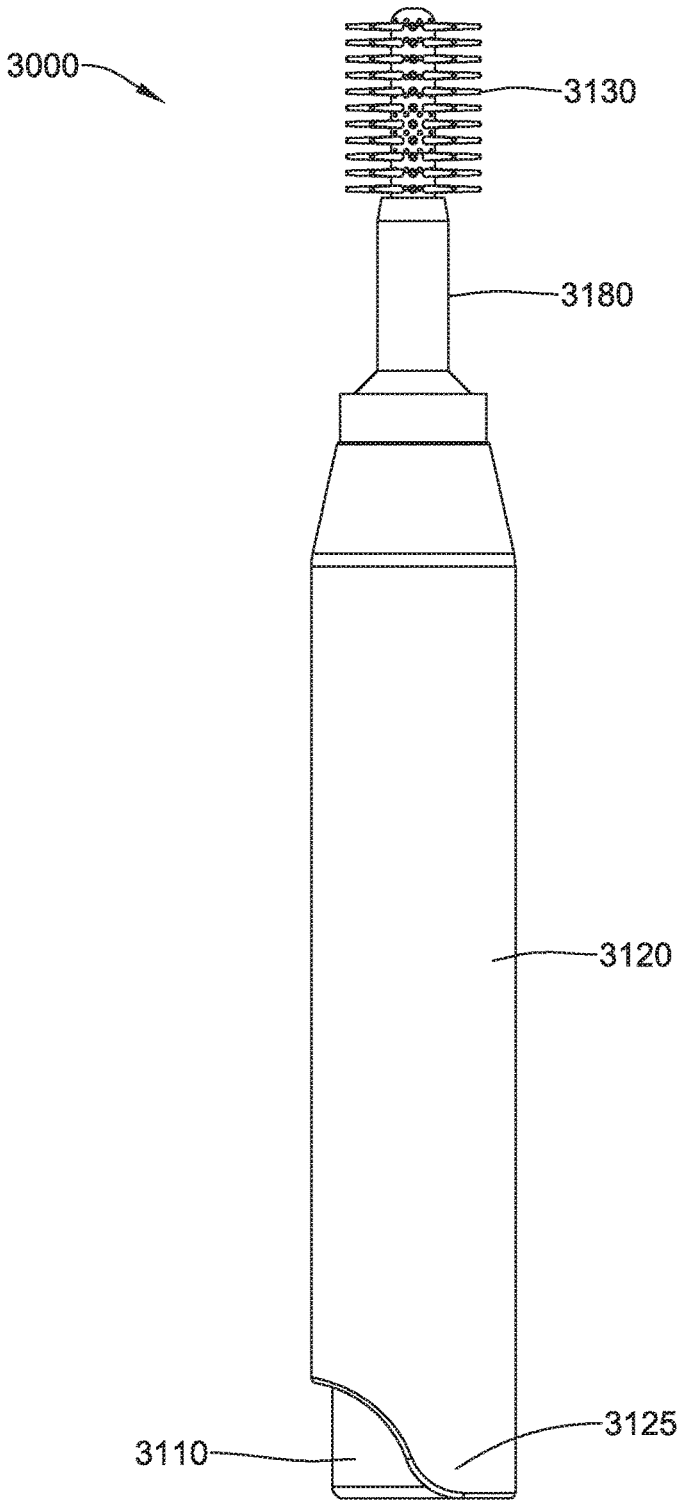
FIG. 11 is a side view of another illustrative dispenser.
Figure 12:
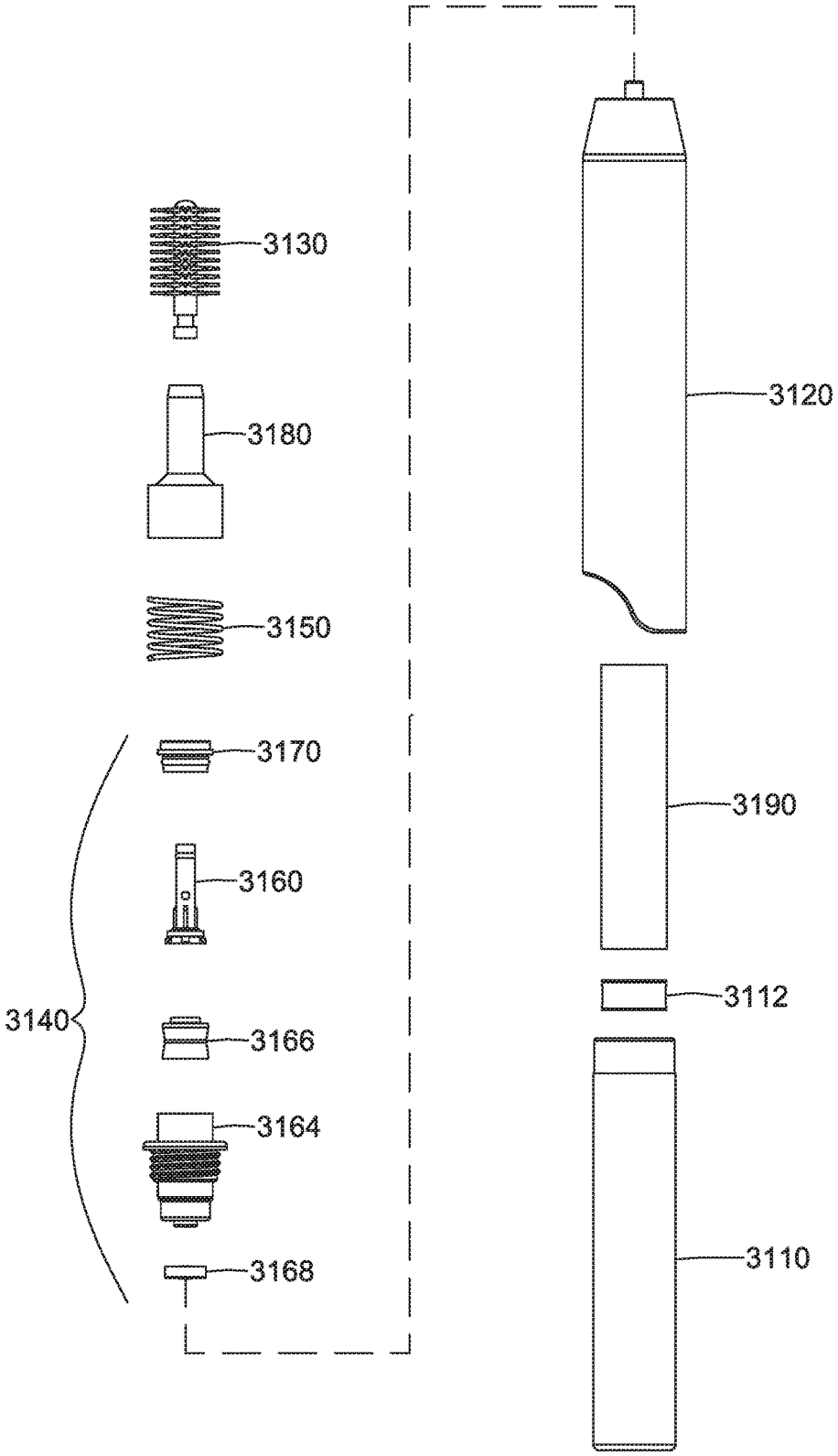
FIG. 12 is a side exploded view of the dispenser of FIG. 11.

The product dispenser illustrated in FIG. 1 takes the form of an airless "chubby" crayon. The dispenser 100 includes an outer shell 120 having a generally cylindrical shape with a tip 130 at a first end for delivery of cosmetic product and an extension 125 at a second end. The tip 130 may narrow conically toward an opening 135 from which the product is delivered, with the second end of the outer shell being generally open. The tip 130 may be a rigid material such as metal, ceramic, stone, glass, or hard plastic. In other examples, the tip 130 may be made of a pliable material such as gel, sponge, pliable plastic, or rubber. In the example shown in FIG. 8, the tip 2130 is a doe foot that may be used with a lip gloss cosmetic product. The tip 2130 may be a gel, sponge, pliable plastic, or rubber and may have a fabric, flocked, or other textured covering. In a further example, a brush tip 3130 may be provided, as shown in FIG. 11. The brush tip 3130 may be used with a mascara or eyebrow gel or coloring product. The brush tip 3130 may be made of a rigid material such as plastic or metal. In other examples, the brush tip 3130 may be made of a pliable plastic or synthetic bristles.

Figure 2:
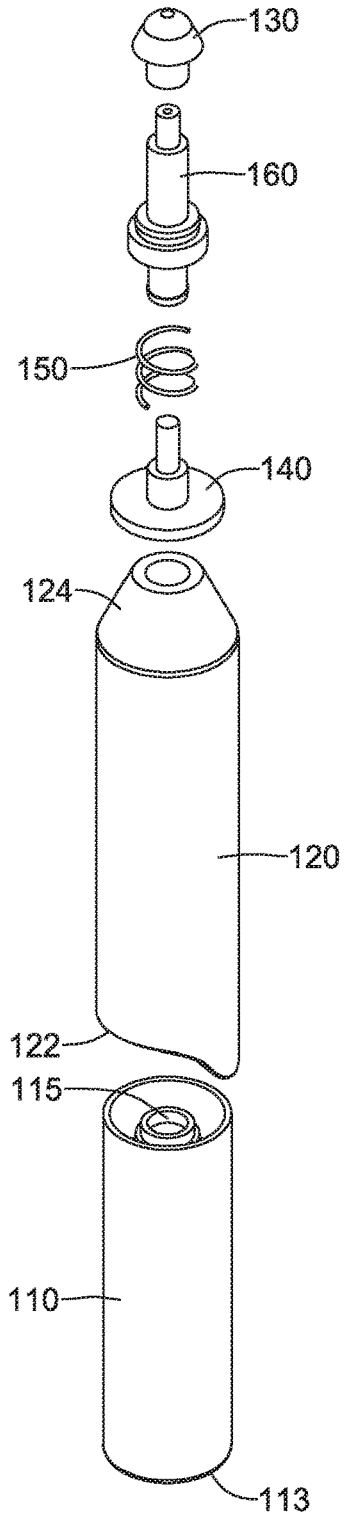
FIG. 2 is a perspective exploded view of the dispenser of FIG. 1.

In the example shown in FIG. 1, the tip 130 may be conical with an opening 135 at the apex. As shown in FIG. 2, the product dispenser may include a product container 110 within the shell 120. The container 110 may have a first end with a dispensing opening 115 for the cosmetic product, and a second end 113 which extends generally to the shell second end 122. The second end of the shell is open and includes a cut-away portion leaving an extension 125, allowing access to a product container (when the product container is present) at a closed end of the product container. The container 110 is slidingly disposed within the shell 120. For a single use device, the product container 110 may be intended to be permanently disposed in the shell 120. In a multiple use device, the product container may be configured to be removed and replaced.

Figure 3:
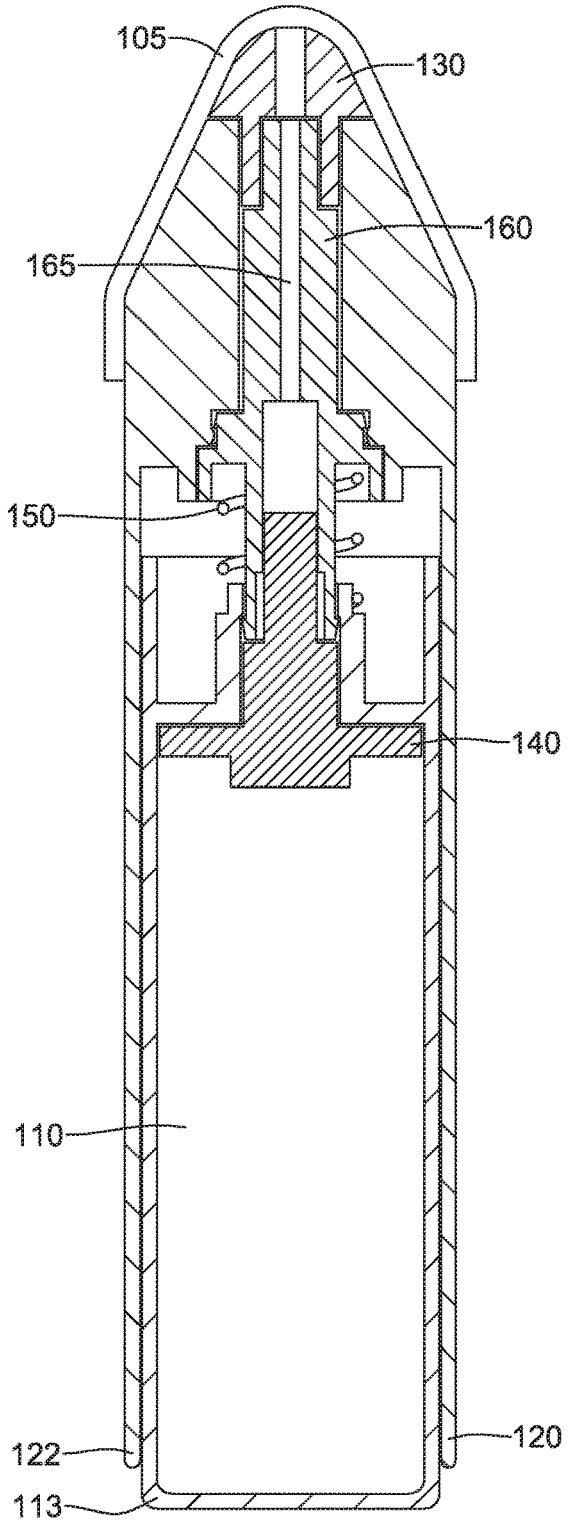
FIG. 3 is a cross sectional view of the dispenser of FIG. 1.

A cap 105 may be provided over the tip 130, as illustrated in FIG. 3. The cap 105 may have a friction fit connection to the shell 120. Alternatively, the cap may have a snap fit, hinge connection, screw connection, or any other suitable connection to the shell. In another example, the product dispenser is capless. In order to prevent inadvertent dispensing of the product, in either a capped or capless dispenser, a lock mechanism (not shown) may be provided to retain the container 110 flush with the extension 125 of the shell until the user desires to dispense the product. One or more shut-off valves (not shown) may be provided in the orifice in the tip 130, in a channel 165 through the insert 160, and/or in the airless pump mechanism 140. The shut-off valve may automatically close off the orifice and/or channel through which product flows, when the container is in the rest position, flush with the extension of the shell, as illustrated in FIG. 3.

An airless pump mechanism 140 is contained within the dispenser. The term airless pump refers to a pump that provides dispensing of a substance from a container under pressure in essentially a single direction without permitting reverse (intake) flow of air via the pump. That is, as product is pumped from the container, the pumped product is not replaced with a corresponding volume of air through the pump. In addition to preventing reverse intake flow of air, an airless pump typically does not allow intake of any other substances to replace the volume of product pumped out of the container. For example, an airless pump could include a one-way valve, such as a check valve.

Figure 4:
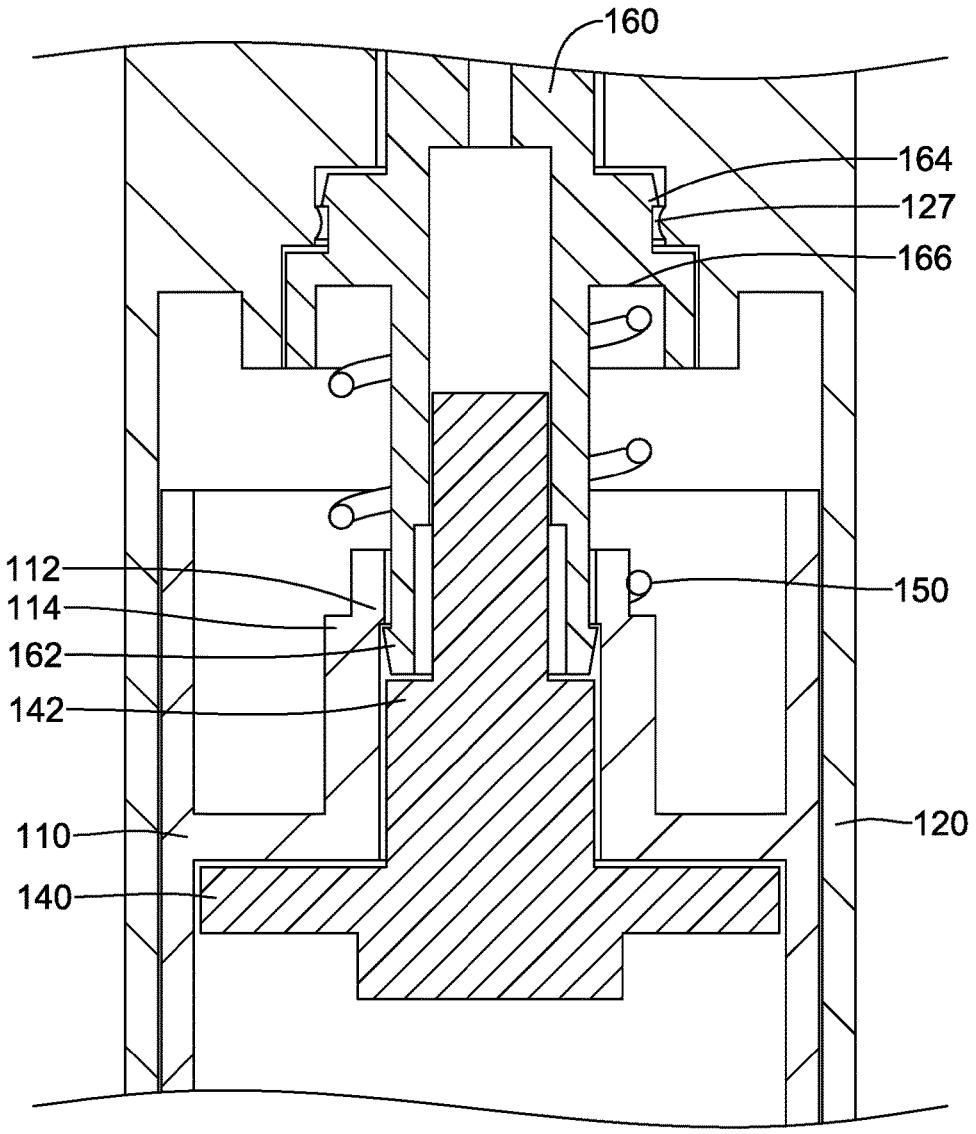
FIG. 4 is a partial close-up view of FIG. 3.

The airless pump mechanism 140 is disposed on the first end of the container 110, as illustrated in FIG. 3. An insert 160 is disposed over the upper portion of the pump mechanism, and a spring 150 is disposed between the airless pump mechanism 140 and the insert 160 with a lower end of the spring engaging an inner neck 114 of the container 110 and an upper end of the spring engaging a surface 166 of the insert, as illustrated in FIG. 4. The spring biases the shell 120 and container 110 apart, thereby biasing the shell second end 122 and the product container second end 113 to be generally flush with one another in a resting state, as illustrated in FIGS. 1 and 3. The pump mechanism 140 is actuated by pushing the second end 113 of the container 110 upwards within the shell 120, toward the tip 130. As the container 110 is pushed upwards, the spring 150 is compressed. Once the desired amount of product is expelled, the container 110 is released. The spring 150 expands to its rest position, forcing the container 110 downward. The airless pump mechanism 140 resides below the conical tip 124 of the shell 120, and is separated from the tip 130 by the insert 160. The insert has a channel 165 extending therethrough, for providing product from the container 110 to the tip opening 135. The insert is connected to the airless pump mechanism 140 with a snap connection. The insert may have a snap connection with the shell 120. The insert 160 has a projection 164 that engages extension 127 on an inner surface of the shell 120. When the projection 164 is engaged with the extension 127, the insert is prevented from moving in a downward direction relative to the shell 120. A second snap connection includes a lip 162 on the lower end of the insert that engages a protrusion 112 on an inner surface of the container 110, as illustrated in FIG. 4. When the lip 162 engages the protrusion 112, the insert is prevented from moving in an upward direction. The lower end of the insert abuts a shoulder 142 on the airless pump mechanism 140, forming an upper stop for the pump mechanism. The dispenser may have one or both of the snap connections. In other examples, the insert may be an integral part of the shell. For example, the insert may be molded as a part of the shell.

The airless pump mechanism 140 allows for an adjustable amount of product to be dispensed, depending on how far the container 110 is pressed upwards with respect to the shell 120, or how many times the container 110 is pressed upwards. Disposing the pump mechanism within the shell keeps the moving parts protected. To dispense product, the container is push upwards relative to the shell to compress the spring apparatus and activate the pump, causing product to be expelled through the opening 135 in the tip 130 via the airless pump mechanism 140 coupled to the first end of the product container.

The airless pump mechanism 140 operates using a one-way valve to allow product to be expelled from the container, but prevents air from entering and contaminating the product container. Other pump mechanisms may be used in place of the airless pump mechanism. The airless pump can expel product simply through an open ended channel or tube terminating at the tip of the shell.

Figure 5:
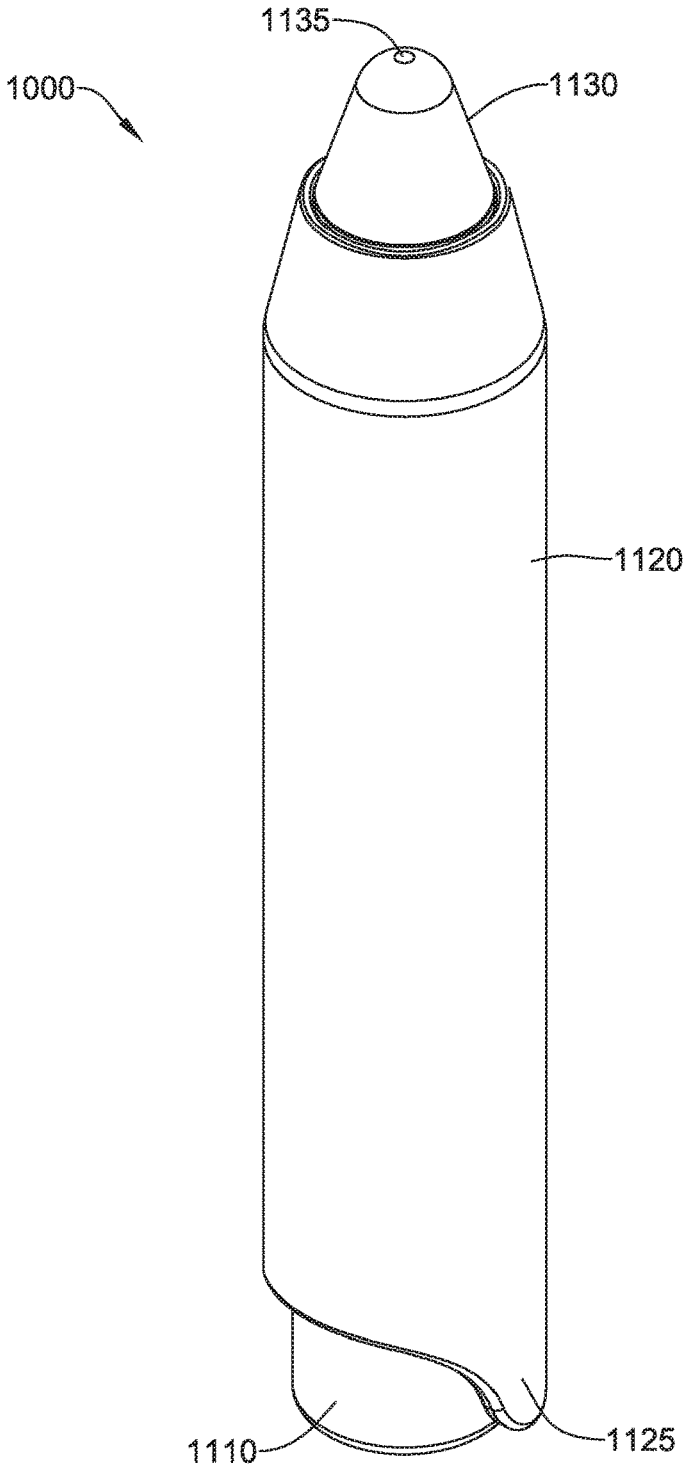
FIG. 5 is a perspective view of another illustrative dispenser.
Figure 6:
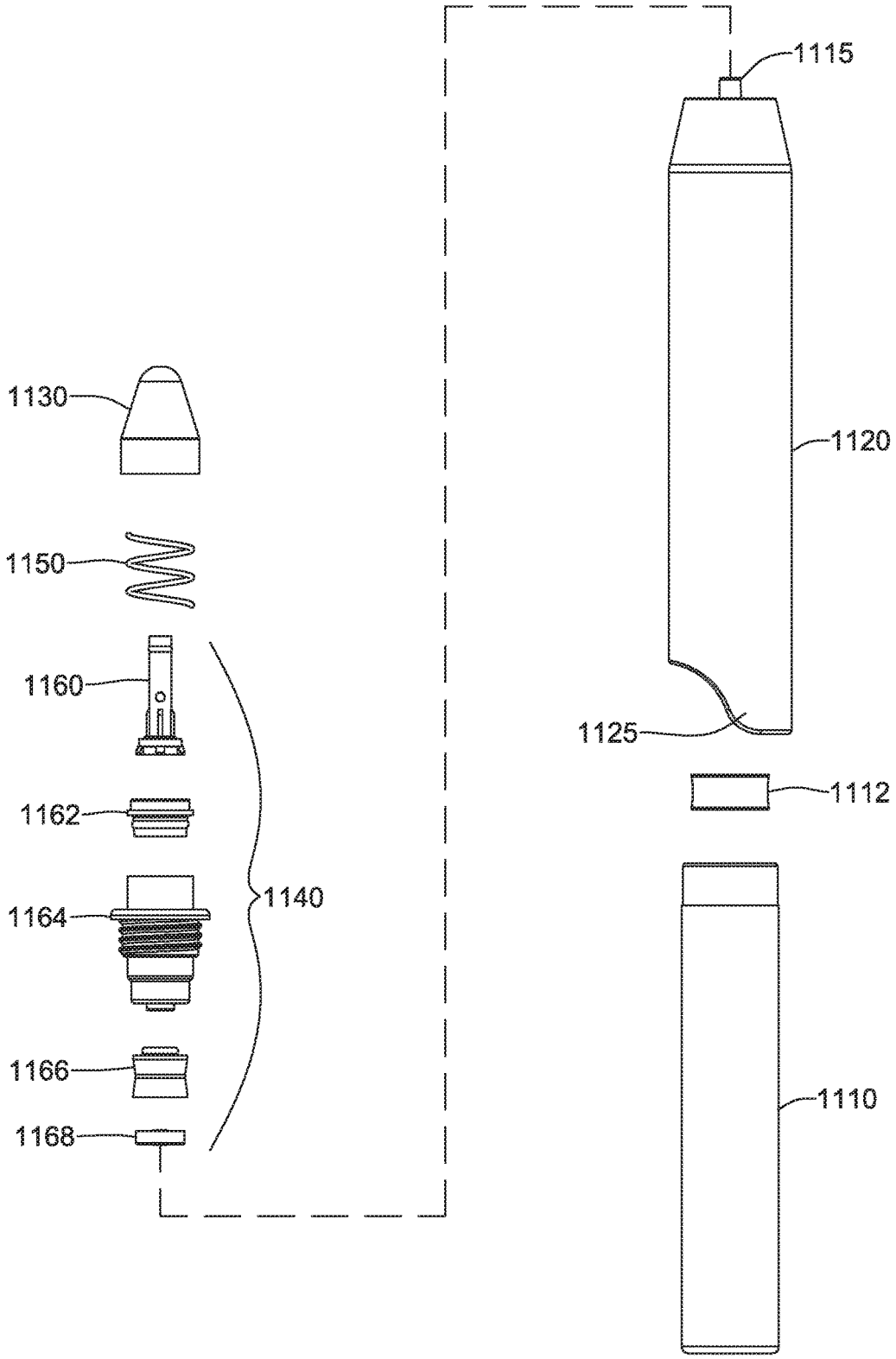
FIG. 6 is a side exploded view of the dispenser of FIG. 5.
Figure 7:
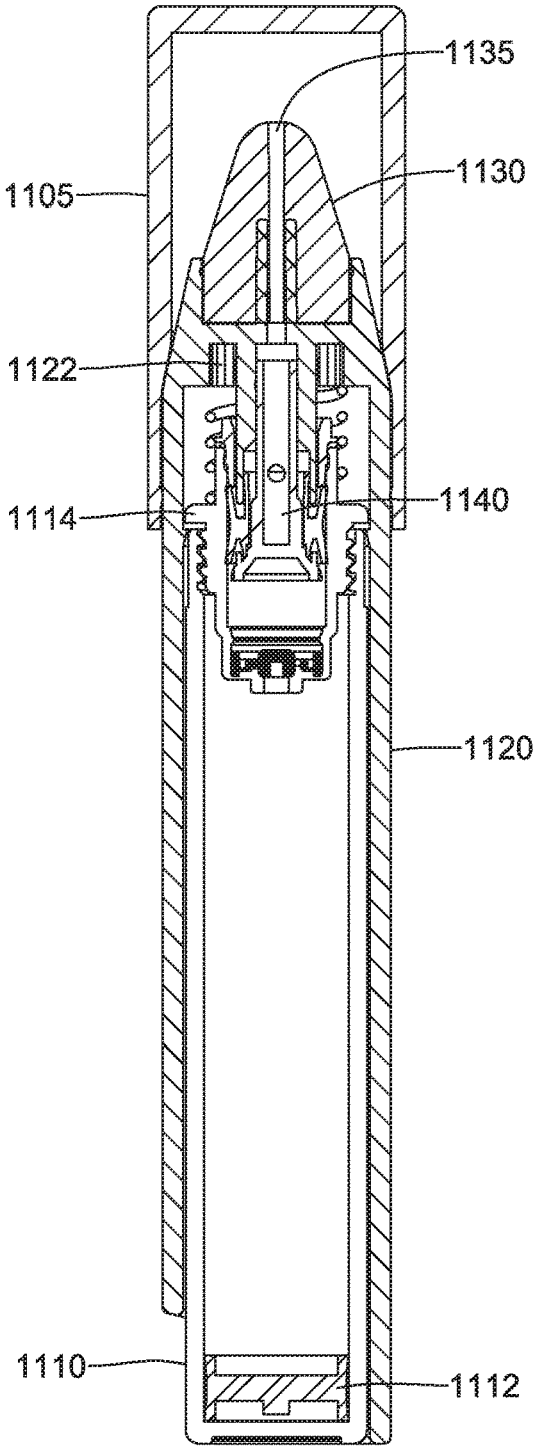
FIG. 7 is a side cross-sectional view of the dispenser of FIG. 5.

A further example of an airless cosmetic dispenser 1000 is shown in FIGS. 5-7. This dispenser is similar to the chubby crayon shown in FIG. 1, having a product container 1110 within a shell 1120 having a dispensing opening 1115 and an opposite open end with a cut-away portion leaving an extension 1125. As in the example shown in FIG. 1, the container 1110 is slidingly disposed within the shell 1120. A piston 1112 may be disposed within the container 1110, as shown in FIG. 7. A cap 1105 may be provided to cover the tip 1130, as shown in FIG. 7. The dispenser 1000 shown in FIG. 6 has an alternative airless pump mechanism 1140. The airless pump mechanism 1140 includes a piston base 1160, pump shoulder cap 1162, pump housing 1164, housing piston 1166, and disc valve 1168. The airless pump mechanism 1140 connects the tip 1130 to the dispensing opening 1115 of the shell 1120, which is connected to the container 1110, as illustrated in FIG. 7. A spring 1150 is disposed between the airless pump mechanism 1140 and the tip 1130 with a lower end of the spring engaging an inner neck 1114 of the container 1110 and an upper end of the spring engaging an inner surface 1122 of the shell 1120, as illustrated in FIG. 7. The spring biases the shell and container apart. The pump mechanism has a channel extending therethrough, for providing product from the container 1110 to the tip opening 1135. As with the dispenser shown in FIG. 1, the pump mechanism 1140 may be actuated by pushing the bottom of the container 1110 upwards within the shell 1120, toward the tip 1130.

Figure 8:
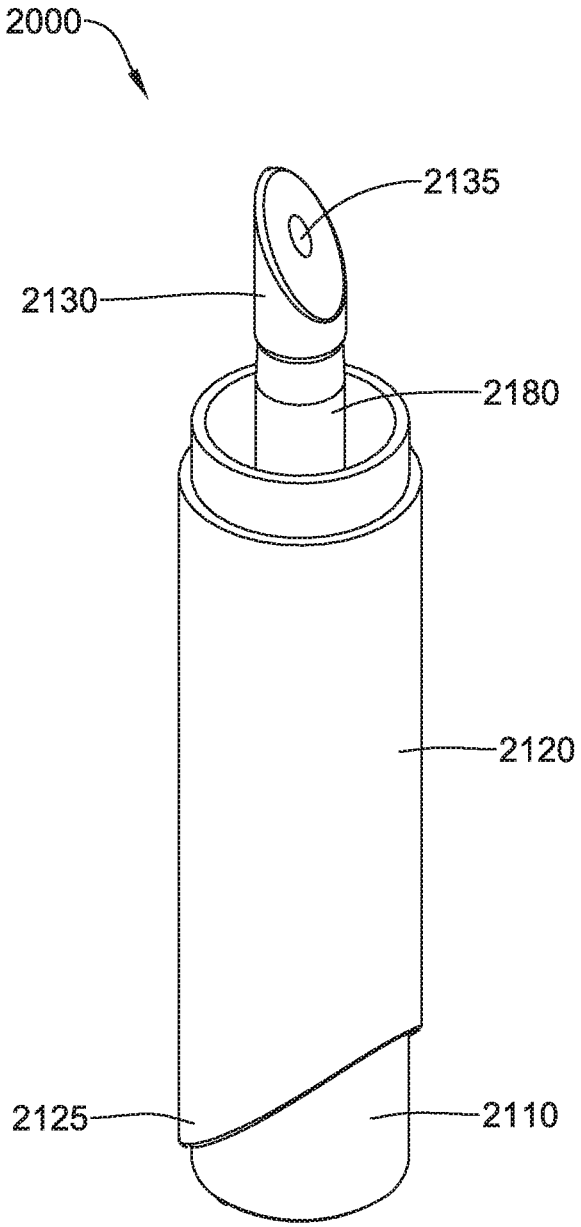
FIG. 8 is a perspective view of another illustrative dispenser.
Figure 9:
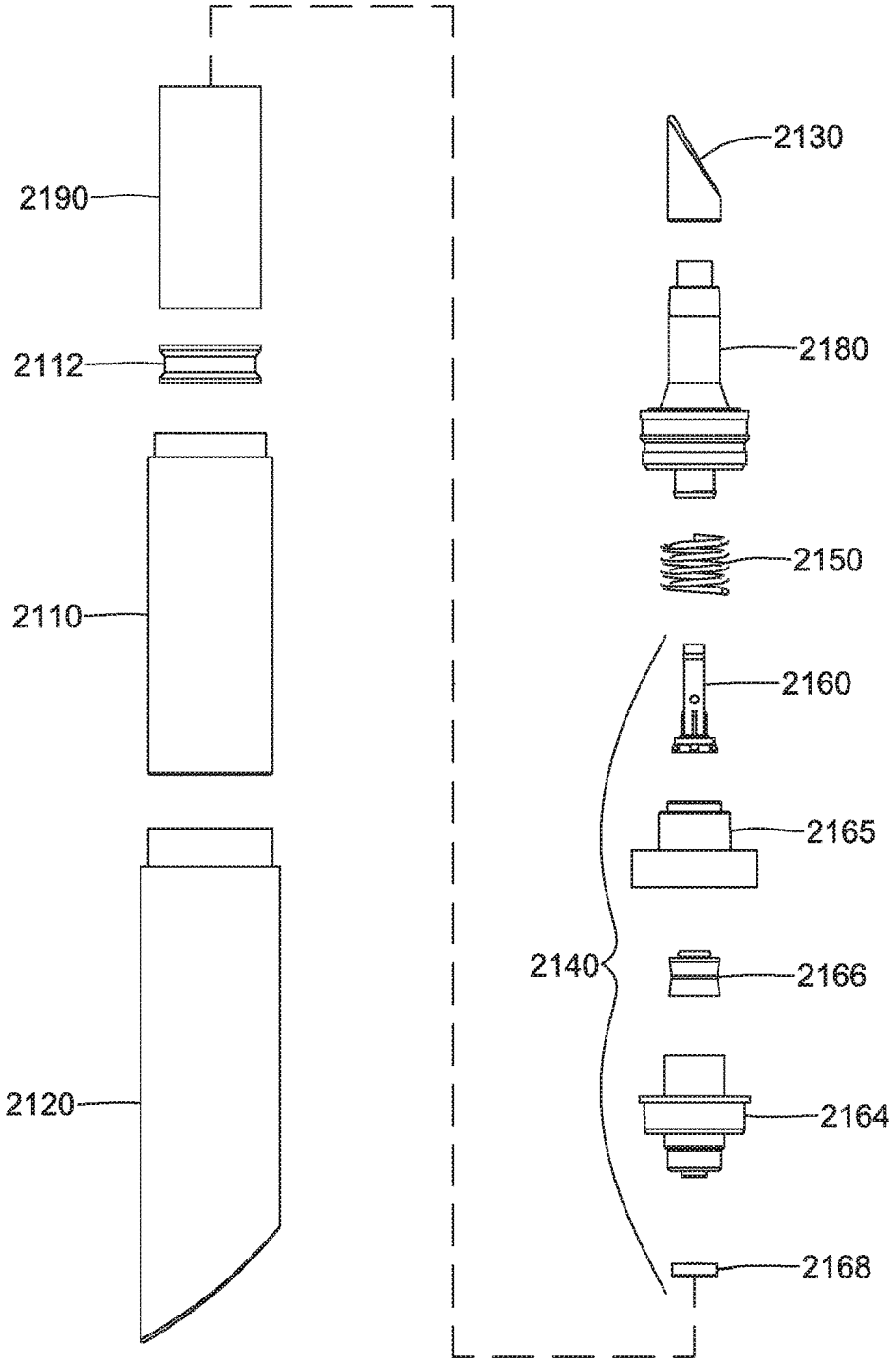
FIG. 9 is a side exploded view of the dispenser of FIG. 8.
Figure 10:
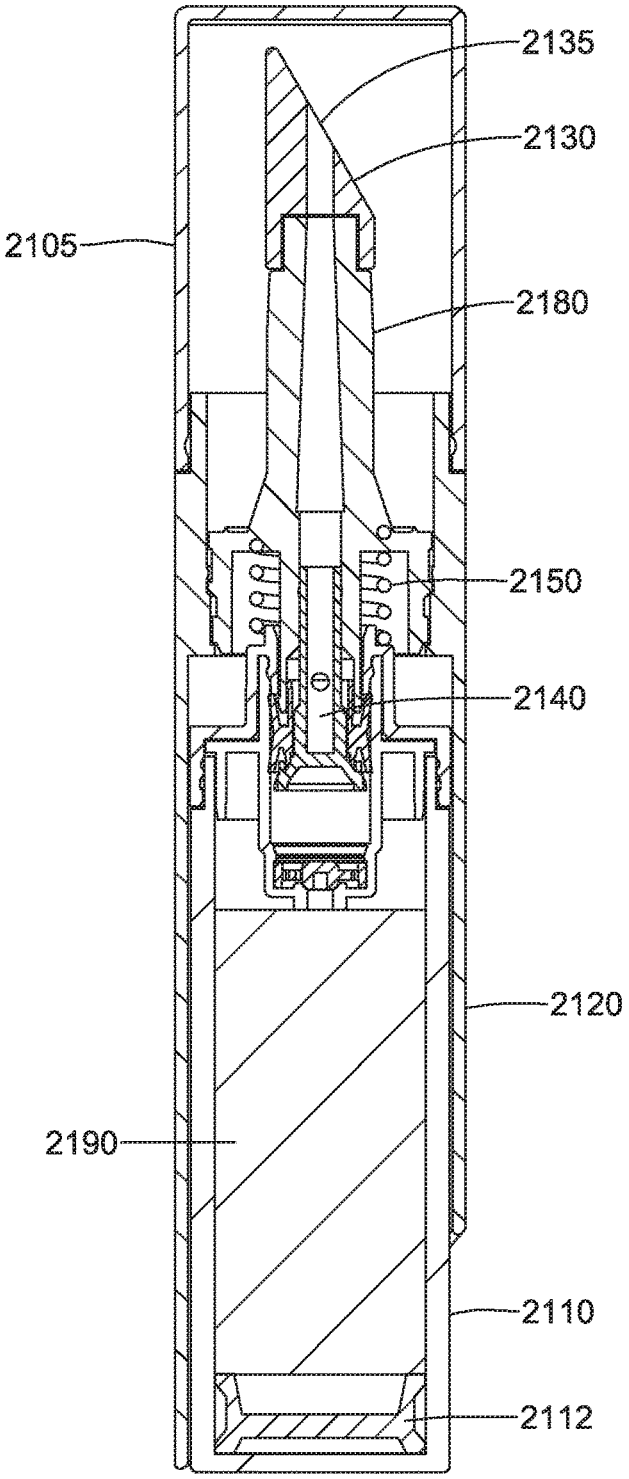
FIG. 10 is a side cross-sectional view of the dispenser of FIG. 8.

A further example of an airless cosmetic dispenser 2000 is shown in FIGS. 8-10. This dispenser is similar to the chubby crayon shown in FIG. 1, having a product container 2110 within a shell 2120 having a bottom open end with a cut-away portion leaving an extension 2125. As in the example shown in FIG. 1, the container 2110 is slidingly disposed within the shell 2120. A piston 2112 may be disposed within the container 2110, as shown in FIG. 10. A cap 2105 may be provided to cover the tip 2130, as shown in FIG. 10. The dispenser 2000 has a doe foot tip 2130 instead of the conical tip shown in FIG. 1. The doe foot tip 2130 is connected to a stem 2180 which is then connected to an airless pump mechanism 2140. The airless pump mechanism 2140 includes a piston base 2160, pump collar 2165, housing piston 2166, pump housing 2164, and disc valve 2168. The stem 2180 connects the tip 2130 to the airless pump mechanism 2140 which is connected to the container 2110, as illustrated in FIG. 10. A liner or cartridge 2190 may be provided inside the container 2110, as shown in FIG. 10. The cartridge 2190 may be removable and replaceable to create a re-Tillable dispenser. A spring 2150 is disposed between the airless pump mechanism 2140 and the stem 2180 with a lower end of the spring engaging the pump collar 2165 and an upper end of the spring engaging the stem 2180, as illustrated in FIG. 10. The spring biases the shell and container apart. The stem 2180 and airless pump mechanism 2140 each have a channel extending therethrough, for providing product from the container 2110 to the doe foot tip opening 2135.

Figure 13:
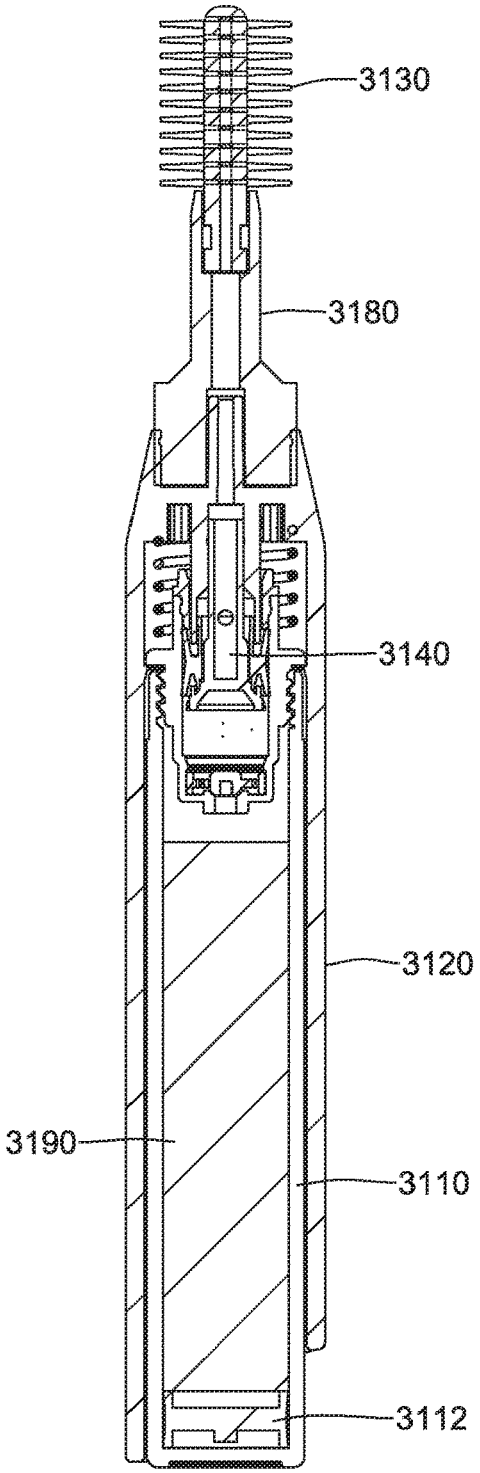
FIG. 13 is a side cross-sectional view of the dispenser of FIG. 11.
Figure 14:
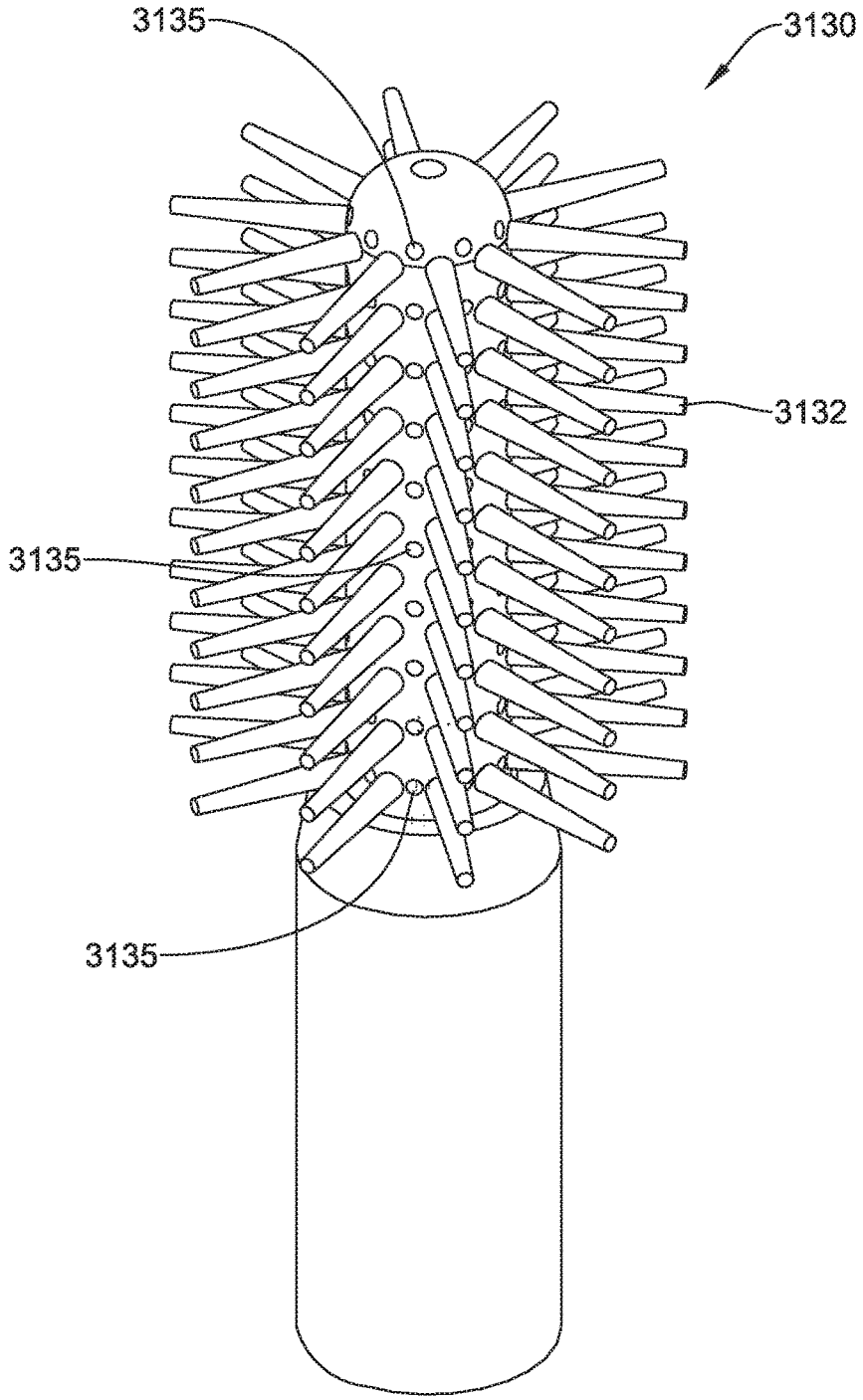
FIG. 14 is a perspective view of the brush tip of the dispenser of FIG. 11.

Another example of an airless cosmetic dispenser 3000 is shown in FIGS. 11-14. This dispenser is similar to the doe foot dispenser shown in FIG. 8, but with a brush tip 3130. The dispenser 3000 has a product container 3110 within a shell 3120 having a bottom open end with a cut-away portion leaving an extension 3125. As in the example shown in FIG. 8, the container 3110 is slidingly disposed within the shell 3120. A piston 3112 may be disposed within the container 3110, as shown in FIG. 13. A cap (not shown) may be provided to cover the tip 2130. The dispenser 3000 has a brush tip 3130 connected to a stem 3180 which is then connected to an airless pump mechanism 3140. The airless pump mechanism 3140 includes a chaplet 3170, a piston base 3160, housing piston 3166, pump housing 3164, and disc valve 3168. The stem 3180 connects the brush tip 3130 to the airless pump mechanism 3140 which is connected to the container 3110, as illustrated in FIG. 13. Similar to the example shown in FIG. 8, the pump mechanism 3140 may be actuated by pushing the bottom of the container 3110 upwards within the shell 3120, toward the tip 3130. A liner or cartridge 3190 may be provided inside the container 3110, as shown in FIG. 13. The cartridge 3190 may be removable and replaceable to create a re-Tillable dispenser. A spring 3150 is disposed between the airless pump mechanism 3140 and the stem 3180 with a lower end of the spring engaging the pump housing 3164 and an upper end of the spring engaging a surface within the shell 3120, as illustrated in FIG. 13. The spring biases the shell and container apart. The stem 3180 and airless pump mechanism 3140 each have a channel extending therethrough, for providing product from the container 3110 to a plurality of openings 3135 in the brush tip 3130. As seen in FIG. 14, the brush tip 3130 may include a plurality of bristles 3132 arranged circumferentially around and along the length of the tip 3130. A plurality of openings 3135 are disposed between bristles, also arranged circumferentially around and along the length of the tip. Similar to the example described above, the pump mechanism 3140 may be actuated by pushing the bottom of the container 3110 upwards within the shell 3120, toward the tip 3130.

While the pump mechanisms 140, 1140, 2140, 3140 may be described as having different components, it will be understood that any of the pump mechanisms may be used with any of the various tips 130, 1130, 2130, 3130. Each of these non-limiting examples can stand on its own, or can be combined in various permutations or combinations with one or more of the other examples. The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein. In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description.

The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A product dispenser comprising:

a container having a closed bottom and an open top;

a shell disposed at least partially over the container, the shell having an open bottom with an extension, and an opening in a top end, the shell configured to receive the container therein with the container bottom being substantially flush with the shell extension in a rest position;

an airless pump mechanism disposed with the open top of the container;

an insert disposed within an upper portion of the shell, the insert having a snap connection with one or both of the shell and the container;

a spring disposed between the airless pump mechanism and the insert, biasing the closed bottom of the container flush with the shell extension; and wherein a bottom end of the spring engages the container and an upper end of the spring engages the insert.

2. The product dispenser of claim 1, wherein the snap connection is between the insert and the shell, the snap connection including a projection on the insert that engages an extension on an inner surface of the shell.

3. The product dispenser of claim 2, wherein the insert has a second snap connection with the container.

4. The product dispenser of claim 3, wherein the second snap connection includes a lip on the insert that engages a protrusion on an inner surface of the container.

5. The product dispenser of claim 1, further comprising a tip disposed within the opening at the top end.

6. The product dispenser of claim 5, wherein the insert has a channel extending longitudinally therethrough, allowing product to travel from the pump mechanism to the tip.

7. The product dispenser of claim 1, further comprising a removable cap disposed over the top end of the shell.

8. The product dispenser of claim 5, wherein the tip has an opening that is fluidly connected to a passageway extending through the pump mechanism and insert to the container.

9. The product dispenser of claim 8, wherein the tip includes a conical application surface with an apex, wherein the opening is in the apex.

10. The product dispenser of claim 8, wherein the tip includes a doe foot applicator.

11. The product dispenser of claim 8, wherein the tip includes a brush.

12. The product dispenser of claim 11, wherein the brush includes a plurality of openings fluidly connected to the passageway.

13. A product dispenser comprising:

a container having a closed bottom and an open top;

a shell disposed at least partially over the container, the shell having an open bottom with an extension, and an opening in a top end, the shell configured to receive the container therein with the container bottom being substantially flush with the shell extension in a rest position;

an airless pump mechanism disposed with the open top of the container;

an insert disposed within an upper portion of the shell, the insert having a snap connection with one or both of the shell and the container;

a spring disposed between the airless pump mechanism and the insert, biasing the closed bottom of the container flush with the shell extension;

wherein a bottom end of the spring engages the container and an upper end of the spring engages the insert; and wherein the snap connection is between the insert and the shell, the snap connection including a projection on the insert that engages an extension on an inner surface of the shell.

14. The product dispenser of claim 13, wherein the insert has a second snap connection with the container.

15. The product dispenser of claim 14, wherein the second snap connection includes a lip on the insert that engages a protrusion on an inner surface of the container.

16. The product dispenser of claim 13, further comprising a tip disposed within the opening at the top end.

17. The product dispenser of claim 16, wherein the insert has a channel extending longitudinally therethrough, allowing product to travel from the pump mechanism to the tip.

18. The product dispenser of claim 13, further comprising a removable cap disposed over the top end of the shell.

19. The product dispenser of claim 16, wherein the tip has an opening that is fluidly connected to a passageway extending through the pump mechanism and insert to the container.

20. The product dispenser of claim 19, wherein the tip includes a conical application surface with an apex, wherein the opening is in the apex.

* * * * *